United States Patent [19]

Matsuda et al.

[11] Patent Number: 4,502,067

[45] Date of Patent: Feb. 26, 1985

[54] HEAT-SENSITIVE BLACK RECORDING MATERIAL

[75] Inventors: Masanori Matsuda, Sakai; Haruo Koyama, Hirakata; Nobuhiro Miyakawa, Abiko, all of Japan

[73] Assignee: Mita Industrial Company Limited, Osaka, Japan

[21] Appl. No.: 509,068

[22] Filed: Jun. 29, 1983

[30] Foreign Application Priority Data

Jun. 30, 1982 [JP] Japan ..... 57-111476

[51] Int. Cl.[3] ..... B41M 5/18

[52] U.S. Cl. ..... 346/214; 346/208; 346/209; 346/217; 346/221; 427/151; 428/913; 428/914

[58] Field of Search ..... 282/27.5; 427/150, 151; 428/320.4–320.8, 411, 488, 537, 913, 914; 346/204, 208, 209, 214, 217, 218, 221

[56] References Cited

FOREIGN PATENT DOCUMENTS

| | | | |
|---|---|---|---|
| 2424935 | 12/1974 | Fed. Rep. of Germany | 346/221 |
| 0005789 | 1/1981 | Japan | 346/221 |
| 0133096 | 8/1982 | Japan | 346/204 |
| 1427318 | 3/1976 | United Kingdom | 346/221 |

*Primary Examiner*—Bruce H. Hess

*Attorney, Agent, or Firm*—Wenderoth, Lind & Ponack

[57] ABSTRACT

Disclosed is a heat-sensitive recording material capable of forming an image of a hue close to a pure black at a low density, which comprises a dispersion of a leuco dye, a heat-fusible organic acidic substance solid at normal temperature and a sensitizing agent in a binder, wherein the leuco dye comprises a fluoran type leuco dye for forming a black color and a benzofluoran type leuco dye for forming a red dye in an amount of 0.01 to 1% by weight based on said black color-forming leuco dye.

15 Claims, No Drawings

HEAT-SENSITIVE BLACK RECORDING MATERIAL

BACKGROUND OF THE INVENTION (1) Field of the Invention

The present invention relates to a heat-sensitive black recording material. More particularly, the present invention relates to a heat-sensitive black recording material which is capable of forming a substantially purely black image not only at a high density but also at a low density with an excellent gradation.

(2) Description of the Prior Art

Conventional heat-sensitive black recording materials are roughly divided into two types. Recording materials of one type comprise a plurality of leuco dyes forming colors complementary to each other by reaction with an acidic substance and recording materials comprising a fluoran type leuco dye for formation of a black color alone. In the heat-sensitive black recording materials of the former type, images having a hue close to a purely black color can be formed at a sufficiently high temperature, but images in which an inherent hue of any of the leuco dyes is strong are formed at a relatively low temperature. Namely, a problem of so-called color shearing arises at a relatively low temperature.

Fluoran type leuco dyes capable of singly forming a black color have recently been developed, and they have been used for commercial products but some problems are left unsolved. More specifically, these fluoran type leuco dyes for forming a black color are relatively low in sensitivity to heat, and therefore, they should be used in combination with a sensitizer such as a fatty acid amide. Moreover, these fluoran type leuco dyes are defective in that when the image density is relatively low, the hue of the formed image tends to become greenish, and this tendency is especially conspicuous when the sensitizing agent is used in combination. Accordingly, in heat-sensitive black recording materials of this type, formation of an image having a good gradation, especially a halftone image, is difficult. Moreover, it is difficult to perform recording at a relatively low temperature.

SUMMARY OF THE INVENTION

We found that when the above-mentioned fluoran type leuco dye for forming a black color is combined with a small amount of a benzofluoran type leuco dye, an image of a hue close to a pure black can be formed not only at a high density but also at a low density, the apparent sensitivity is increased, and this heat-sensitive black recording material is excellent in the gradation and the halftone-reproducing property and also in the recording property at a relatively low temperature.

It is therefore a primary object of the present invention to provide a heat-sensitive black recording material in which the problem of color shearing caused when a fluoran type leuco dye for forming a black dye is used in combination with a sensitizing agent is solved.

Another object of the present invention is to provide a heat-sensitive recording material capable of forming an image of a hue close to a pure black color which can be formed not only at a high image density but also at a low image density.

Still another object of the present invention is to provide a heat-sensitive recording material which is excellent in the gradation and the halftone-reproducing property and in which recording is possible even at a relatively low temperature.

More specifically, in accordance with the present invention, there is provided a heat-sensitive recording element capable of forming an image of a hue close to a pure black at a low density, which comprises a dispersion of a leuco dye, a heat-fusible organic acidic substance solid at normal temperature and a sensitizing agent in a binder, wherein the leuco dye comprises a fluoran type leuco dye for forming a black color and a benzofluoran type leuco dye for forming a red dye in an amount of 0.01 to 1% by weight based on said black color-forming leuco dye.

DETAILED DESCRIPTION OF THE INVENTION

As pointed out hereinbefore, in the present invention, a fluoran type leuco dye for forming a black dye is used in combination with a small amount of a benzofluoran type leuco dye.

Known black color-forming fluoran type leuco dyes heretofore used in this field can be used in the present invention. Preferred leuco dyes of this type are compounds represented by the following general formula:

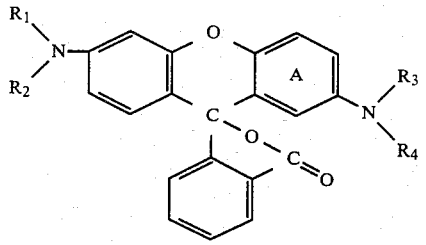

(1)

wherein $R_1$ and $R_2$ each stand for an alkyl or aryl group having up to 4 carbon atoms or $R_1$ and $R_2$ are bonded to form a nitrogen-containing heterocyclic ring group together with the nitrogen atom, $R_3$ stands for a hydrogen atom or a lower alkyl or aralkyl group, $R_4$ stands for an unsubstituted or substituted aryl group, and the ring A may be substituted with a halogen atom or an alkyl group.

As the lower alkyl group in the formula (1), there can be mentioned methyl, ethyl and propyl groups, and as the aryl group in the formula (1), there can be mentioned phenyl and methylphenyl (tolyl) groups. As preferred examples of the nitrogen-containing heterocyclic ring group formed by the group

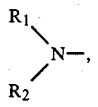

there can be mentioned piperidino, pyrrolidino and morpholino groups, and as preferred examples of the aralkyl group, there can be mentioned benzyl and phenethyl groups. As preferred examples of the substituent on the substituted aryl group, there can be mentioned halogen atoms such as chlorine and bromine atoms, haloalkyl groups such as trifluoromethyl and trichloromethyl groups, alkyl groups such as ethyl and butyl groups and alkoxy groups such as methoxy and ethoxy groups. A plurality of substituents as mentioned above may be present on the aryl group.

Of course, these groups $R_1$, $R_2$, $R_3$ and $R_4$ are selected and combined so that when the leuco dye is reacted with an organic acidic substance, a color of a black hue is formed.

As specific examples of the black color-forming leuco dye, there can be mentioned 2-(2-chloroanilino)-6-diethylaminofluoran, 2-(2-chloroanilino)-6-di-n-butylaminofluoran, 2-(2-trifluoromethyl-N-ethylanilino)-6-dimethylaminofluoran, 2-(2-trifluoromethyl-N-benzylanilino)-6-dimethylaminofluoran, 2-(2-trifluoromethylanilino)-6-diethylaminofluoran and 2-(4-n-butylanilino)-3-methyl-6-pyrrolidinofluoran.

Any of the known benzofluoran type leuco dyes used for forming a red color in this field can optionally be used as the benzofluoran type leuco dye to be combined with the black color-forming fluoran type leuco dye. Preferred benzofluoran type leuco dyes are compounds represented by the following general formula:

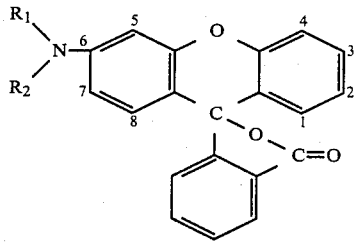

(2)

wherein $R_1$ and $R_2$ each stand for an alkyl group having up to 4 carbon atoms or an aryl group are bonded to form a nitrogen-containing heterocyclic group together with the nitrogen atom, and the ring B may have a ring fused thereto to form a naphthalene ring as a whole and said naphthalene ring may be substituted with a hydroxyl group, an alkoxy group, an amino group or an substituted amino group.

In the above general formula (2), the benzene ring may be fused to the ring B at an optional position, but it is preferred that the benzene ring be fused at the 1,2- or 3,4-position of the ring B.

As preferred examples of the red color-forming leuco dye, there can be mentioned 6-diethylamino-3,4-benzofluoran, 2-acetylamino-6-diethylamino-3,4-benzofluoran, 2-acetylamino-6-dimethylamino-3,4-benzofluoran, 2-N-acetyl-N-propargylamino-6-diethylamino-3,4-benzofluoran, 2-N-acetyl-N-allylamino-6-diethylamino-3,4-benzofluoran, 2-N-benzolamino-6-dimethylamino-3,4-benzofluoran, 2-N-cinnamoylamino-6-dipropylamino-3,4-benzofluoran, 6-morpholino-3,4-benzofluoran, 6-diethylamino-1,2-benzofluoran and 2-N-acetyl-N-methylamino-6-diethylamino-3,4-benzofluoran.

In the present invention, there can be attained very prominent advantages by selecting the above-mentioned benzofluoran type leuco dye among various red color-forming leuco dyes and combining it with the system comprising a black color-forming fluoran type leuco dye and a sensitizing agent. More specifically, as described hereinbefore, in the system comprising a black color-forming fluoran type leuco dye and a phenol type color former, the color-forming temperature is relatively high and therefore, use of a sensitizing agent such as a fatty acid amide is indispensable. However, when the black color-forming fluoran type leuco dye is combined with the sensitizing agent, if the image density is low, the hue is greenish rather than black. In contrast, if the red color-forming benzofluoran type leuco dye is used according to the present invention, this leuco dye promptly forms a red color, which is complementary to the above-mentioned green color, at a relatively low temperature where the black color-forming fluoran type dye gives only a greenish image of a low density, and therefore, an image having a hue close to a purely black color as a whole can be obtained not only at a high density but also at a low density. Accordingly, the problem of color shearing is solved, and a heat-sensitive black recording material excellent in the gradation and the halftone-reproducing property is provided according to the present invention.

Furthermore, since a purely black image is obtained at a low density, thermal recording is possible at a relatively low density or at a relatively low temperature and the apparent sensitivity is increased.

In the present invention, it is important that the red color-forming benzofluoran type leuco dye should be used in an amount of 0.01 to 1% by weight, especially 0.1 to 0.5% by weight, based on the black color-forming leuco dye. If the amount of the red color-forming leuco dye is too small and below the above range, it is impossible to obtain a purely black image at a low density, and if the amount of the red color-forming leuco dye is too large and exceeds the above range, the formed image is reddish as a whole or contamination of the background due to color formation is readily caused.

In the present invention, as the color former for the leuco dyes, there is used an organic acidic substance which is solid at normal temperature and is heat-fusible. For example, there may be used phenols such as 4,4'-isopropylidene diphenol, 4,4'-methylene-bis(2,6-di-tert-butylphenol), 4,4'-isopropylidene-bis(2-chlorophenol), 4,4'-isopropylidene-bis(2,6-dichlorophenol), 4,4'-isopropylidene-bis(2,6-dimethylphenol), 4,4'-isopropylidene-bis(2-tert-butylphenol), 4,4'-sec-isobutylidene-bis(2-methylphenol), 4,4'-cyclohexylidenediphenol, 2,2'-thiobis(4,6-dichlorophenol), p-tert-butylphenol, 3,4-dichlorodiphenol, O,O'-diphenol, 4-hydroxydiphenoxide, 2,2'-dihydroxy-bisphenol, 2,2'-methylene-bis(4-chlorophenol), 2,6-dihydroxybenzoic acid, 1-hydroxy-2-naphthol-carboxylic acid and a vinyl phenol polymer.

As the sensitizing agent, there are used animal, vegetable and mineral waxes such as paraffin wax and carnauba wax, stearic acid, soaps, higher fatty acids and their derivatives such as fatty acid amides, and synthetic waxy substances such as polyethylene wax, polypropylene wax and polyethylene glycol.

In the present invention, any of water-soluble and water-dispersible binders used for thermal recording materials of this type can be used. As preferred examples of the binder, there can be mentioned polyvinyl alcohol, starch, carboxymethyl starch, hydroxyethyl starch, carboxymethyl cellulose, ethyl cellulose, gum arabic, gelatin, casein, polyvinyl pyrrolidone, polyacrylamide, styrene-maleic acid salt copolymer, vinyl ether-maleic acid salt copolymer and styrene-butadiene copolymer latex.

In the present invention, particles of the combined leuco dyes and particles of the phenol type color former are dispersed in an aqueous medium containing the above-mentioned water-soluble or water-dispersible binder to form a coating liquid composition.

In the present invention, it is preferred that the leuco dyes (A) and the phenol type color former (B) be used at an (A)/(B) weight ratio of from 1/0.5 to 1/40, especially from 1/1 to 1/20. It also is preferred that the sensitizing agent (C) be used in an amount of 10 to 1000% by weight, especially 50 to 300% by weight, based on the color former (B). Moreover, it is preferred that the leuco dyes be present in the recording layer in an amount of 2 to 60% by weight, especially 5 to 40% by weight, as solids based on the total composition. If the amount of the leuco dyes or the phenol type color former is too small and below the above range, the image density is reduced, and if the amount of the leuco dyes or the phenol type color former is too large and exceeds the above range, no particular merits are attained in connection with the image density and the like but economical disadvantages are brought about.

It is preferred that the binder be used in an amount of 20 to 80% by weight, especially 25 to 60% by weight, based on the sum of the leuco dyes and color former.

In preparing this coating liquid composition, it is preferred that a dispersion of the phenol type color former be formed by adding particles of the phenol type color former to an aqueous solution of the water-soluble or water-dispersible binder and wet-pulverizing the mixture. Solid particles of the leuco dyes are directly dispersed in this dispersion of the color former, or solid particles of the leuco dyes are separately dispersed in an aqueous solution of the water-soluble or water-dispersible binder and the dispersion of the leuco dyes is mixed with the dispersion of the color former. From the viewpoint of the adaptability to the coating operation, it is preferred that the solid concentration in the coating liquid composition be 8 to 20% by weight.

Known additives may be incorporated into the thermal recording layer in known amounts so as to improve various characteristics of the thermal recording layer. For example, a white pigment or a filler such as clay or calcium carbonate may be added to improve the whiteness of the recording layer or attain a bulking effect. Furthermore, an alkanol amine such as triethanol amine or other organic base may be added for preventing color formation in the background. Moreover, a water resistance-improving agent, a defoaming agent and the like may be incorporated according to need.

Paper, non-woven fabric, artifical paper, film, metal foil or laminate thereof may optionally be used as a substrate on which the recording layer is to be formed. It is preferred that the recording layer be formed in an amount coated of 2 to 10 g/m$^2$, especially 3 to 8 g/m$^2$, as solids.

The heat-sensitive recording element of the present invention is valuable as a recording element for a facsimile device, printer, data communication device, computer terminal device, measuring device, passometer or copying machine in which a thermal head, infrared ray flash lamp or laser is used as a heat source.

The present invention will now be described in detail with reference to the following Examples that by no means limit the scope of the invention.

EXAMPLES 1 THROUGH 3

| | |
|---|---|
| Liquid A: | |
| 2-(2-Chloroanilino)-6-diethylaminofluoran | 5 parts by weight |
| Aqueous solution containing 5% by weight of etherified starch | 17.5 parts by weight |
| Aqueous solution containing 5% by weight of polyvinyl pyrrolidone | 17.5 parts by weight |
| Water | 5 parts by weight |
| Liquid B: | |
| 6-Diethylamino-3,4-benzofluoran | 5 parts by weight |
| Aqueous solution containing 5% by weight of polyvinyl alcohol | 17.5 parts by weight |
| Aqueous solution containing 5% by weight of polyvinyl pyrrolidone | 17.5 parts by weight |
| Water | 5 parts by weight |
| Liquid C: | |
| Bisphenol A | 5 parts by weight |
| Stearic acid amide | 5 parts by weight |
| Aqueous solution containing 5% by weight of etherified starch | 70 parts by weight |
| Water | 10 parts by weight |

The above liquids A, B and C were separately pulverized and dispersed in ball mills for 24 hours, and a coating liquid composition was prepared by mixing the liquids A, B and C so that the liquid A/liquid B/liquid C weight ratio was 100/0.1/200. The coating liquid composition was uniformly coated on one surface of wood-free paper having a basis weight of 58 g/m$^2$ by a wire bar so that the amount coated was about 6 g/m$^2$ after drying, and the coating was dried with hot air maintained at 60° C. to obtain a heat-sensitive recording paper (Example 1).

Color formation was effected in this heat-sensitive recording paper under a pressing pressure of 5.0 Kg/cm$^2$ at a temperature of 75° to 100° C. for 1 second by using a commercially available stamp type color formation tester (supplied by Toyo Seiki Seisakusho).

Heat-sensitive recording papers were prepared in the same manner as described above except that the liquid A/liquid B/liquid C weight ratio was changed to 100/0.5/200 (Example 2) or 100/1/200 (Example 3).

These recording papers were subjected to the color formation test under the same conditions by using the same tester as described above.

EXAMPLE 4

| | |
|---|---|
| Liquid A: | |
| 2-(2-Chloroanilino)-6-diethylaminofluoran | 5 parts by weight |
| Aqueous solution containing 5% by weight of polyvinyl alcohol | 17.5 parts by weight |
| Aqueous solution containing 5% by weight of polyvinyl pyrrolidone | 17.5 parts by weight |
| Water | 5 parts by weight |
| Liquid B: | |
| 6-Diethylamino-3,4-benzofluoran | 5 parts by weight |
| Aqueous solution containing 5% by weight of polyvinyl alcohol | 17.5 parts by weight |
| Aqueous solution containing 5% by weight of polyvinyl pyrrolidone | 17.5 parts by weight |
| Water | 5 parts by weight |
| Liquid C: | |
| Bisphenol A | 5 parts by weight |
| N—Methylolstearic acid amide | 5 parts by weight |
| Aqueous solution containing 5% by weight of acetyl starch | 70 parts by weight |
| Water | 10 parts by weight |

The above liquids A, B and C were separately pulverized and dispersed for 24 hours in ball mills, and a coating liquid composition was prepared by mixing the liquids A, B and C at a liquid A/liquid B/liquid C weight ratio of 100/0.5/200. In the same manner as described in Example 1, a recording paper was prepared, and the color formation test was carried out under the same conditions by using the same tester as in Example 1.

COMPARATIVE EXAMPLES 1 THROUGH 3

Heat-sensitive recording papers (Comparative Examples 1 and 2) were prepared in the same manner as described in Examples 1 and 4, respectively, except that a coating liquid composition prepared by mixing the liquids A and C at a weight ratio of 100/200 was used. The color formation test of these recording papers was carried out under the same conditions by using the same tester as described in Example 1.

A heat-sensitive recording paper (Comparative Example 3) was prepared in the same manner as described in Example 4 except that 2-[3,6-bis(diethylamino)-9-(anilino)xanthyl]-benzoic acid lactam was used instead of 6-diethylamino-3,4-benzofluoran used in the liquid B of Example 4, and the recording paper was subjected to the color formation test under the same conditions by using the same tester as described in Example 1.

With respect to each of the color-formed samples, the reflection densities of the color-formed portion and the non-color-formed portion (background portion) were measured by using a commercially available reflection densitometer [Model PDA65 supplied by Konishiroku Shashin Kogyo (an amber filter was used)], and the hue of the low-density color-formed portion having a density of about 0.52 was examined under a room fluorescent lamp by using standard color chips (glazed chips supplied by the Japanese Association of Standards; JIS Z-8721). The obtained results are shown in Table 1.

TABLE 1

| | Black Color-Forming Leuco Dye/Red Color-Forming Leuco Dye Weight Ratio | HV/C of Standard Color Chip* | Hue |
|---|---|---|---|
| Example 1 | 100/0.1 | N6 | achromatic |
| Example 2 | 100/0.5 | N6 | achromatic |
| Example 3 | 100/1 | N6 | achromatic |
| Example 4 | 100/0.5 | N6 | achromatic |
| Comparative Example 1 | black color-forming leuco dye alone | 5.0G5.8/1.6 | greenish |
| Comparative Example 2 | black color-forming leuco dye alone | 2.5G6.0/2.0 | greenish |
| Comparative Example 3 | 100/0.5 | 5.0G6.0/1.6 | greenish |

Note*
H: hue
V: lightness
C: saturation

From the results shown in Table 1, it is seen that when a black color-forming leuco dye is singly used or a red color-forming leuco dye other than that of the present invention is combined, the hue is greenish, but when it is combined with a red color-forming leuco dye according to the present invention, the hue becomes achromatic. Namely, according to the present invention, the low-density color-formed portion (halftone portion) is purely black and clear, and therefore, the apparent density is increased and a high-quality recorded image having a high contrast with no visual discrepancy is obtained.

We claim:

1. A heat-sensitive recording material capable of forming an image of a hue close to a pure black at a low density, which comprises a dispersion of a leuco dye, a heat-fusible organic acidic substance solid at normal temperature and a sensitizing agent in a binder, wherein the leuco dye comprises a fluoran type leuco dye for forming a black color, which is a compound represented by the following general formula:

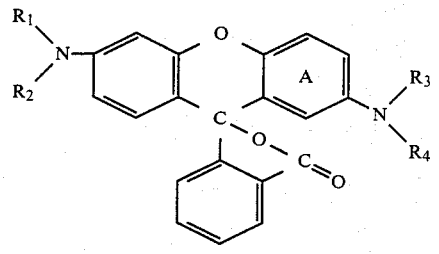

wherein $R_1$ and $R_2$ each represent an alkyl or aryl group having up to 4 carbon atoms or $R_1$ and $R_2$ are bonded to form a nitrogen-containing heterocyclic ring group together with the nitrogen atom, $R_3$ represents a hydrogen atom or a lower alkyl or aralkyl group, $R_4$ represents an unsubstituted or substituted aryl group, and the ring A may be substituted with a halogen atom or an alkyl group, and a benzofluoran type leuco dye for forming a red dye, which is a compound represented by the following general formula:

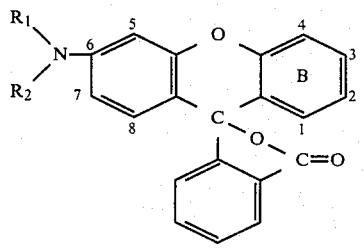

wherein $R_1$ and $R_2$ each represent an alkyl group having up to 4 carbon atoms or an aryl group and are bonded to form a nitrogen-containing heterocyclic group together with the nitrogen atom, and the ring B may have a ring fused thereto to form a naphthalene ring as a whole and said naphthalene ring may be substituted with a hydroxyl group, an alkoxy group, an amino group or a substituted amino group, in an amount of 0.01 to 1% by weight based on said black color-forming leuco dye.

2. A heat-sensitive recording material as set forth in claim 1, wherein the fluoran type leuco dye is a member selected from the group consisting of 2-(2-chloranilino)-6-diethylaminofluoran, 2-(2-chloroanilino)-6-di-n-butylaminofluoran, 2-(2-trifluoromethyl-N-ethylanilino)-6-dimethylaminofluoran, 2-(2-trifluoromethyl-N-benzylanilino)-6-dimethylaminofluoran, 2-(2-trifluoromethylanilino)-6-diethylaminofluoran and 2-(4-n-butylanilino)-3-methyl-6-pyrrolidinofluoran.

3. A heat-sensitive recording material as set forth in claim 1, wherein the benzofluoran type leuco dye is a member selected from the group consisting of 6-diethylamino-3,4-benzofluoran, 2-acetylamino-6-diethylamino-3,4-benzofluoran, 2-acetylamino-6-dimethylamino-3,4-benzofluoran, 2-N-acetyl-N-propargylamino-6-diethylamino-3,4-benzofluoran, 2-N-acetyl-N-allylamino-6-diethylamino-3,4-benzofluoran, 2-N-benzoylamino-6-dimethylamino-3,4-benzofluoran, 2-N-cinnamoylamino-6-dipropylamino-3,4-benzofluoran, 6-morpholino-3,4-benzofluoran, 6-diethylamino-1,2-benzofluoran and 2-N-acetyl-N-methylamino-6-diethylamino-3,4-benzofluoran.

4. A heat-sensitive recording material as set forth in claim 1, wherein the amount of the benzofluoran type leuco dye is 0.1 to 0.5% by weight based on the fluoran type leuco dye.

5. A heat-sensitive recording material as set forth in the claim 1, wherein the heat-fusible organic acidic substance is a phenol type color former selected from the group consisting of 4,4'-isopropylidene diphenol, 4,4'-methylene-bis(2,6-di-tert-butylphenol), 4,4'-isopropylidene-bis(2-chlorophenol), 4,4'-isopropylidene-bis(2,6-dichlorophenol), 4,4'-isopropylidene-bis(2,6-dimethylphenol), 4,4'-isopropylidene-bis(2-tert-butylphenol), 4,4'-sec-isobutylidene-bis(2-methylphenol), 4,4'-cyclohexylidene-diphenol, 2,2'-thiobis(4,6-dichlorophenol), p-tert-butylphenol, 3,4-dichlorodiphenol, O,O'-diphenol, 4-hydroxydiphenoxide, 2,2'-dihydroxy-bisphenol, 2,2'-methylene-bis(4-chlorophenyl), 2,6-dihydroxybenzoic acid, 1-hydroxy-2-naphthol-carboxylic acid and a vinyl phenol polymer.

6. A heat-sensitive recording material as set forth in claim 1, wherein the sensitizing agent is an animal, vegetable or mineral wax, stearic acid, a soap, a higher fatty acid, a higher fatty acid derivative or a synthetic waxy substance.

7. A heat-sensitive recording material as set forth in claim 1, wherein the binder is a member selected from the group consisting of polyvinyl alcohol, starch, carboxymethyl starch, hydroxyethyl starch, carboxymethyl cellulose, ethyl cellulose, gum arabic, gelatin, casein, polyvinyl pyrrolidone, polyacrylamide, styrene-maleic acid salt copolymer, vinyl ether-maleic acid salt copolymer and styrene-butadiene copolymer latex.

8. A heat-sensitive recording material as set forth in claim 1, wherein the weight ratio of the leuco dyes to the heat-fusible organic acidic substance is in the range of from 1/0.5 to 1/40.

9. A heat-sensitive recording material as set forth in claim 8, wherein the weight ratio of the leuco dyes to the heat-fusible organic acidic substance is in the range of from 1/1 to 1/20.

10. A heat-sensitive recording material as set forth in claim 1, wherein the amount of the sensitizing agent is 10 to 1000% by weight based on the heat-fusible organic acidic substance.

11. A heat-sensitive recording material as set forth in claim 10, wherein the amount of the sensitizing agent is 50 to 300% by weight based on the heat-fusible organic acidic substance.

12. A heat-sensitive recording material as set forth in claim 1, wherein the amount of the leuco dyes is 2 to 60% by weight as solids based on the total composition.

13. A heat-sensitive recording material as set forth in claim 12, wherein the amount of the leuco dyes is 5 to 40% by weight as solids based on the total composition.

14. A heat-sensitive recording material as set forth in claim 1, wherein the amount of the binder is 20 to 80% by weight based on the sum of the leuco dyes and the heat-fusible organic acidic substance.

15. A heat-sensitive recording material as set forth in claim 14, wherein the amount of the binder is 25 to 60% by weight based on the sum of the leuco dyes and the heat-fusible organic acidic substance.

* * * * *